US010886626B2

(12) United States Patent
Zhang et al.

(10) Patent No.: US 10,886,626 B2
(45) Date of Patent: Jan. 5, 2021

(54) CONFIGURABLE PHASED ANTENNA ARRAY

(71) Applicant: wiSpry, Inc., Irvine, CA (US)

(72) Inventors: Jin Zhang, Aalborg (DK); Shuai Zhang, Aalborg (DK); Gert Frølund Pedersen, Storvorde (DK)

(73) Assignee: WISPRY, INC., Irvine, CA (US)

( * ) Notice: Subject to any disclaimer, the term of this patent is extended or adjusted under 35 U.S.C. 154(b) by 26 days.

(21) Appl. No.: 16/265,646

(22) Filed: Feb. 1, 2019

(65) Prior Publication Data

US 2019/0237882 A1 Aug. 1, 2019

Related U.S. Application Data

(60) Provisional application No. 62/625,123, filed on Feb. 1, 2018.

(51) Int. Cl.
*H01Q 21/06* (2006.01)
*H01Q 3/24* (2006.01)
*H01Q 21/29* (2006.01)

(52) U.S. Cl.
CPC ..... *H01Q 21/061* (2013.01); *H01Q 3/24* (2013.01); *H01Q 21/29* (2013.01)

(58) Field of Classification Search
CPC ..... H01Q 21/061; H01Q 3/24; H01Q 21/29
USPC ..... 343/853
See application file for complete search history.

(56) References Cited

U.S. PATENT DOCUMENTS 4,814,777 A * 3/1989 Monser ..... H01Q 21/205 343/727
6,480,162 B2 * 11/2002 Sabet ..... H01Q 1/36 343/767
9,391,375 B1 7/2016 Bales et al.
2010/0238075 A1 * 9/2010 Pourseyed ..... H01Q 21/28 343/702
2011/0273349 A1 * 11/2011 McQuaid ..... H01Q 13/085 343/767
2012/0046003 A1 * 2/2012 Ying ..... H04B 1/406 455/90.2
2013/0207865 A1 * 8/2013 Shtrom ..... H01Q 3/24 343/833
2016/0048713 A1 2/2016 Bellows et al.
(Continued)

FOREIGN PATENT DOCUMENTS

WO WO 2019/152859 A1 8/2019

OTHER PUBLICATIONS

International Search Report and Written Opinion for Application No. PCT/US2019/016382 dated May 22, 2019.

*Primary Examiner* — Don P Le
(74) *Attorney, Agent, or Firm* — Jenkins, Wilson, Taylor & Hunt, P.A.

(57) ABSTRACT

The present subject matter relates to devices, systems, and methods for beam steering in which a configurable antenna assembly includes a first antenna element configured to radiate in a first broadside direction and a second antenna element configured to radiate in an endfire direction. In some embodiments, the configurable antenna assembly further includes a third antenna element configured to radiate in a second broadside direction substantially opposite to the first broadside direction. Such devices, systems, and methods can further be configured such that one of the antenna elements is selectively connected to a common signal feed.

23 Claims, 13 Drawing Sheets

(56) References Cited

U.S. PATENT DOCUMENTS

| | | | | |
|---|---|---|---|---|
| 2017/0012359 | A1 | 1/2017 | Jung et al. | |
| 2017/0237154 | A1* | 8/2017 | Choudhury | H01Q 25/04 343/824 |
| 2018/0351250 | A1* | 12/2018 | Achour | H01Q 1/364 |

* cited by examiner

CONFIGURABLE PHASED ANTENNA ARRAY

PRIORITY CLAIM

The present application claims priority to U.S. Patent Application Ser. No. 62/625,123, filed Feb. 1, 2018, the disclosure of which is incorporated herein by reference in its entirety.

TECHNICAL FIELD

The subject matter disclosed herein relates generally to wireless antenna devices. More particularly, the subject matter disclosed herein relates to a beam steerable antenna array.

BACKGROUND

Beam steerable antenna arrays having high gain and wide coverage in the space are required for 5G systems to compensate the path loss associated with cm-wave and mm-wave operating frequencies. Phased arrays are conventionally used to increase the gain while the coverage of only one phased array is limited. Multiple arrays can be installed to get higher 3D space coverage, but this can lead to bulky structures and complicated feeding networks that can limit the application of cm-wave and mm-wave in mobile terminals.

SUMMARY

In accordance with this disclosure, devices, systems, and methods for beam steering are provided. In one aspect, a configurable antenna assembly having at least two antenna elements is provided. In some embodiments, the configurable antenna assembly includes a first antenna element configured to radiate in a first broadside direction and a second antenna element configured to radiate in a first endfire direction. In some embodiments, the configurable antenna assembly further includes a third antenna element configured to radiate in a second broadside direction substantially opposite to the first broadside direction. A plurality of switching elements are configured to selectively connect one of the at least two antenna elements to a common signal feed.

In another aspect, a configurable phased antenna array comprises a plurality of such configurable antenna assemblies in communication with a common signal feed, and the plurality of configurable antenna assemblies are operable as a phased array to steer an aggregate signal beam in a desired direction.

In yet another aspect, a method for operating a phased antenna array comprises supplying an RF input from a common signal feed to a plurality of configurable antenna assemblies, each of the plurality of configurable antenna assemblies comprising at least a first antenna element configured to radiate in a first broadside direction and a second antenna element configured to radiate in a first endfire direction. The method further comprises selectively connecting one of the antenna elements of each of the plurality of configurable antenna assemblies to the common signal feed.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides systems and methods for signal beam steering. In one aspect, the present subject matter provides a configurable antenna assembly in which a first antenna element is configured to radiate in a first broadside direction, and a second antenna element is configured to radiate in a first endfire direction. In some embodiments, the first antenna element is a patch antenna positioned on a side of a substrate, and the second antenna element is provided in the form of one or more monopole or other similar radiating element. In some embodiments, the configurable antenna assembly can further include one or more additional antenna elements to provide additional directional control of the beam produced by the assembly. In some embodiments, for example, a third antenna element can be configured to radiate in a second broadside direction substantially opposite to the first broadside direction. In some embodiments, the third antenna element is a patch antenna positioned on an opposing side of the substrate with respect to the first antenna element. In any arrangement, the assembly of antenna elements can have a low-profile form factor that can readily be implemented in handheld mobile devices.

Figure 1A:
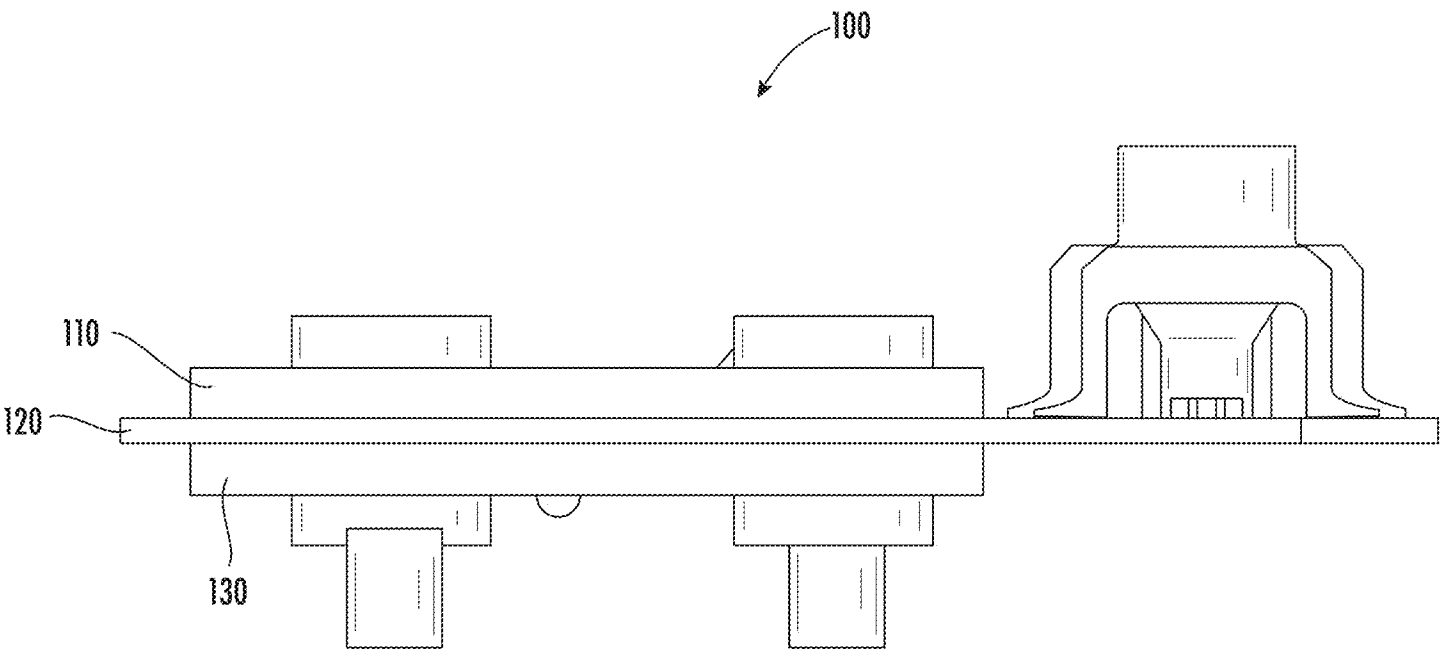
FIGS. 1A, 1B, and 1C are a side view, a top view, and a bottom view of an antenna element according to an embodiment of the presently disclosed subject matter.
Figure 1B:
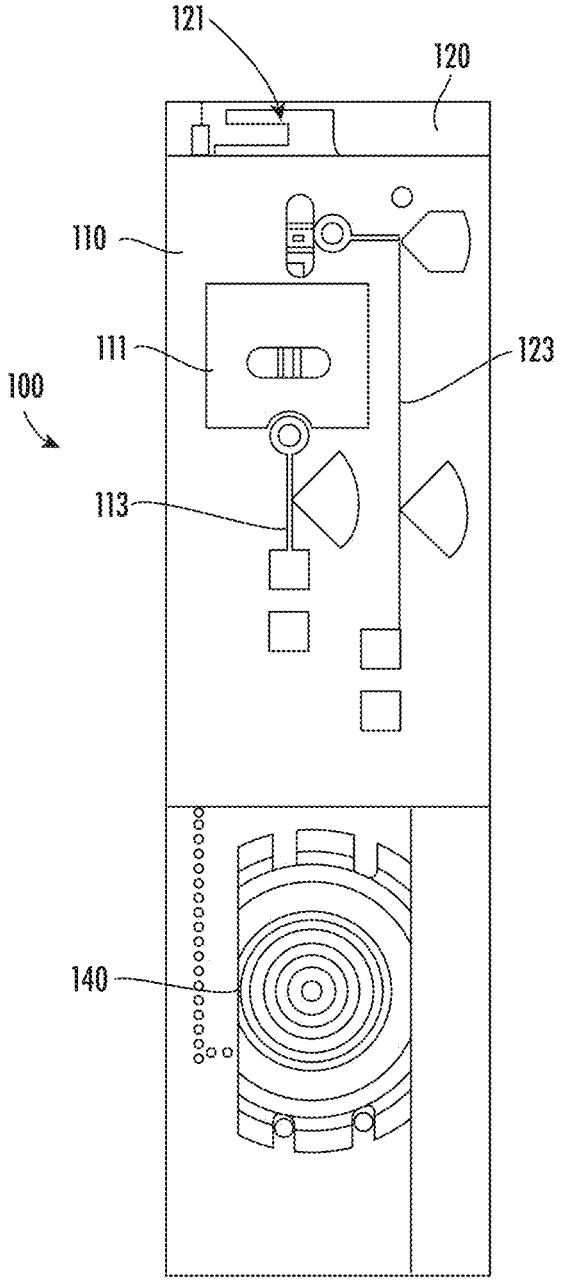
Figure 1C:
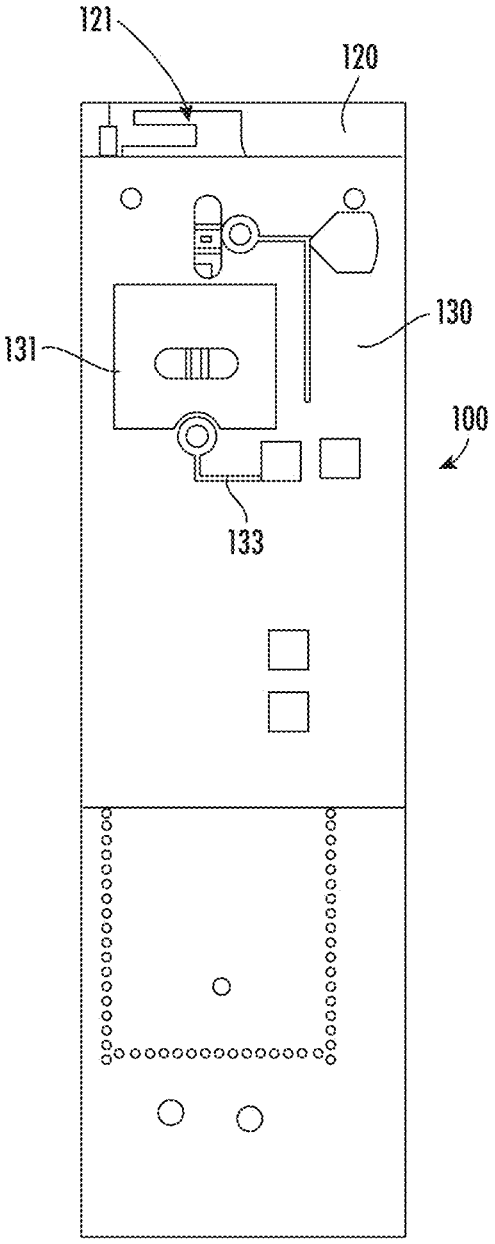

FIGS. 1A, 1B, and 1C illustrate a side view, a top view, and a bottom view of a configurable antenna assembly, generally designated 100, which can be constructed in three layers. In some embodiments, each "layer" comprises a dielectric material on which one or more metal layers is formed. Those having ordinary skill in the art will recognize that, although the embodiment of a prototype assembly shown in FIG. 1A shows screws being used to secure the layers to one another, any of a variety of other assembly mechanisms may be used to assemble the multi-layer structure. As shown in FIG. 1B, a first layer 110 of antenna assembly 100 includes a first antenna element 111 that is configured to radiate in a first broadside direction with respect to antenna assembly 100. In some embodiments, first antenna element 111 is a patch antenna. In some embodiments, first layer 110 further includes a first feeding line 113 connected to first antenna element 111 and a second feeding line 123 connected to a second antenna element 120.

Figure 2B:
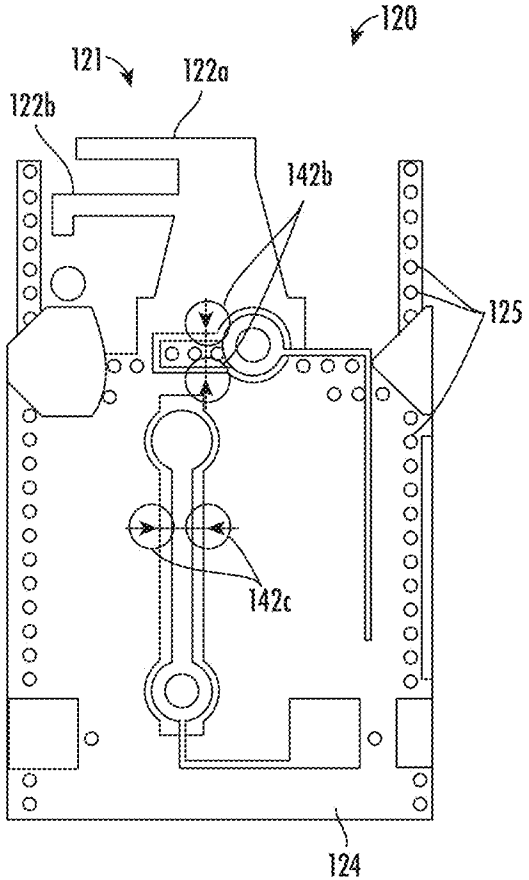
FIGS. 2A and 2B are top and bottom plan views of an antenna element according to an embodiment of the presently disclosed subject matter.
Figure 2A:
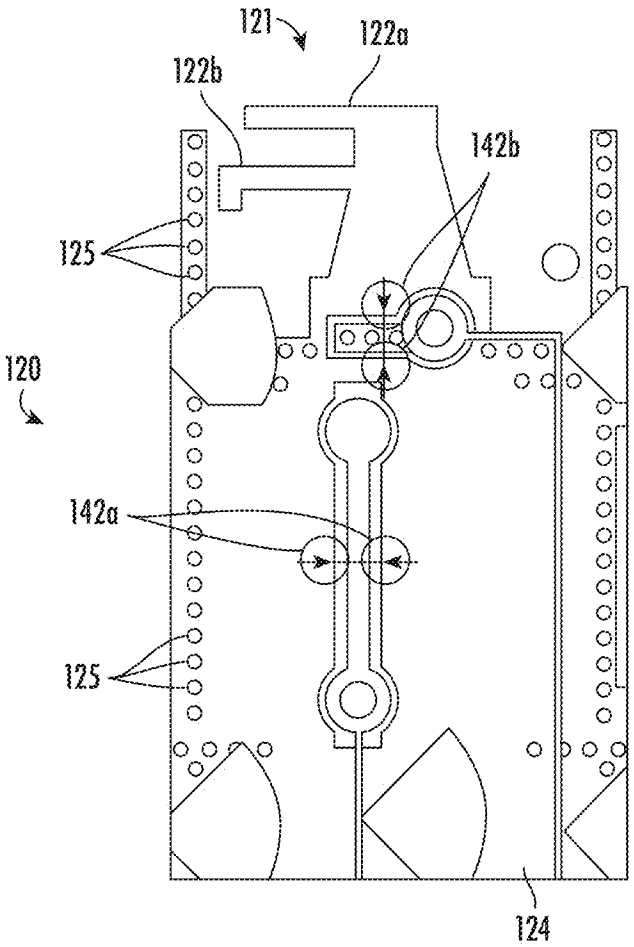

A second layer 120 is positioned in communication with first layer 110. As shown in FIGS. 2A and 2B, in some embodiments, second layer 120 includes second antenna element 121 that is configured to radiate in an endfire direction with respect to antenna assembly 100. In some embodiments, second layer 120 further includes a substrate integrated waveguide (SIW) 124 in communication with a common device input 140 that is connected to a signal feed. As will be understood by those having ordinary skill in the art, a substrate integrated waveguide can be formed within a substrate by adding a top metal over the ground plane and caging the structure with rows of plated vias 125 on either side.

As discussed above, in some embodiments, antenna assembly 100 can further include one or more additional antenna elements. As shown in FIG. 1C, a third layer 130 of antenna assembly 100 that is positioned against a surface of second layer 120 opposite from first layer 110. In the illustrated embodiment, third layer 130 includes a third antenna element 131 that is configured to radiate in a second broadside direction with respect to antenna assembly 100, the second broadside direction being substantially opposite the first broadside direction. The first and second broadside directions are referred to herein as "forward" and "backward" for ease of understanding, although those having ordinary skill in the art will recognize that the principles discussed herein are not limited to any particular orientation for antenna assembly 100, and thus the terms "forward" and "backward" should not be understood to require that first antenna element 111 and/or third antenna element 131 be located in specific positions relative to the device with which they are associated. In some embodiments, third antenna element 131 is a second patch antenna. In some embodiments, third layer 130 further includes a third feeding line 133 connected to third antenna element 131.

FIGS. 4A and 4B show the top and bottom layout of second layer 120. As shown in these Figures, in some embodiments, second antenna element 121 includes two arms 122*a* and 122*b* that are spaced apart by a slot, with this arrangement being configured to achieve a desired bandwidth for the endfire radiating mode. The vias 125 of the SIW 124 are extended to the top of second antenna element 121 for increasing the element-to-element isolation (i.e., between adjacent antenna assemblies). In some embodiments, arms 122*a* and 122*b* of second antenna element 121 can be folded to avoid contacting vias 125, such as is shown in FIGS. 2A and 2B with second arm 122*b* having a shape that turns at an end to maintain a spacing from vias 125.

Antenna assembly 100 further includes switching elements that are configured to be selectively activated to control which antenna element is fed. In some embodiments, the switching elements are PIN diodes. In such a configuration, a pair of PIN diodes can be provided for each switched connection as illustrated in FIGS. 2A and 2B, with each PIN diode in the pair being arranged such that one end is in communication with SIW 124 and the other end is in communication with the respective antenna element. That being said, those having ordinary skill in the art will recognize that the concepts discussed herein are not limited to the use of PIN diodes, and the switching elements can be provided in any of a variety of other forms, including but not limited to field-effect transistors (FET), bipolar junction transistors (BJT), or other semiconductor transistors, or micro-electro-mechanical systems (MEMS) switches.

In some embodiments, all switching elements are soldered on second layer 120 and can be divided into three groups. One or more first switching elements 142*a* are associated with first antenna element 111. In the arrangement illustrated in FIGS. 1A and 2A, first switching elements 142*a* are set on a long slot in a first side of SIW 124 for controlling the broadside radiation from first antenna element 111. One or more second switching elements 142*b* are associated with second antenna element 121. In the embodiment shown in FIGS. 2A and 2B, second switching elements 142*b* are set on loop slots on a top part of SIW 124 for controlling the endfire radiation from second antenna element 121. As illustrated in FIGS. 2A and 2B, in some embodiments, a set of second switching elements 142*b* is provided on both a first side of SIW 124 and a second opposing side of SIW 124. In embodiments that include third antenna element 131, one or more third switching elements 142*c* are associated with third antenna element 131. In the arrangement illustrated in FIGS. 1B and 2B, third switching elements 142*c* are set on a long slot in a second side of SIW 124 for controlling the broadside radiation from first antenna element 111.

In this arrangement, the selective operation of first, second, and third switching elements 142*a*, 142*b*, and 142*c* enables each antenna assembly 100 to switch among different radiation modes: the endfire radiation mode associated with second antenna element 121 and two broadside radiation modes pointing to the forward and backward direction generated by the first antenna element 111 and third antenna element 131, respectively. To control the switching among the antenna elements, antenna assembly 100 can be connected to one or more control elements that are configured to control the switching among the directional components. In some embodiments, such a control element can include a DC control system that is configured to provide differential voltage signals to first, second, and third switching elements 142*a*, 142*b*, and 142*c* to control the selective activation of the directional antenna elements. Alternatively, in some other embodiments, a digital control system can include a serial or parallel bus in communication with each of first, second, and third switching elements 142*a*, 142*b*, and 142*c*.

In some embodiments, for example, first, second, and third switching elements 142*a*, 142*b*, and 142*c* are reversed-biased such that the working modes and switching states are selected based on the combinations shown in Table 1:

TABLE 1

| | First switching elements 142a | Second switching elements 142b | Third switching elements 142c |
|---|---|---|---|
| "Forward" Broadside | off | on | on |
| Endfire | on | off | on |
| "Backward" Broadside | on | on | off |

In this regard, to produce a radiation pattern pointing in a first, "forward" broadside direction, first switching elements 142*a* are turned off and the remaining second and third switching elements 142*b* and 142*c* are turned on. In this configuration, all the energy will radiate through first antenna element 111. Conversely, to produce a radiation pattern from third antenna element 131 pointing in a second, "backward" broadside direction, third switching elements 142*c* are turned off, and first and second switching elements 142*a* and 142*b* are turned on. Finally, to produce endfire radiation from second antenna element 121, second switching elements 142*b* are off and first and third switching elements 142*a* and 142*c* are on so that the energy will not leak through first and second antenna elements 111 and 131. Although one particular switching regime is discussed above, those having ordinary skill in the art will recognize that any of a variety of other switching arrangements can be used with antenna assembly 100 disclosed herein. Further in this regard, as discussed above, antenna assembly 100 can include fewer or more than three antenna elements, and control of switching elements associated with these antenna elements can be configured to correspondingly allow switching among the different directional elements.

Figure 3:
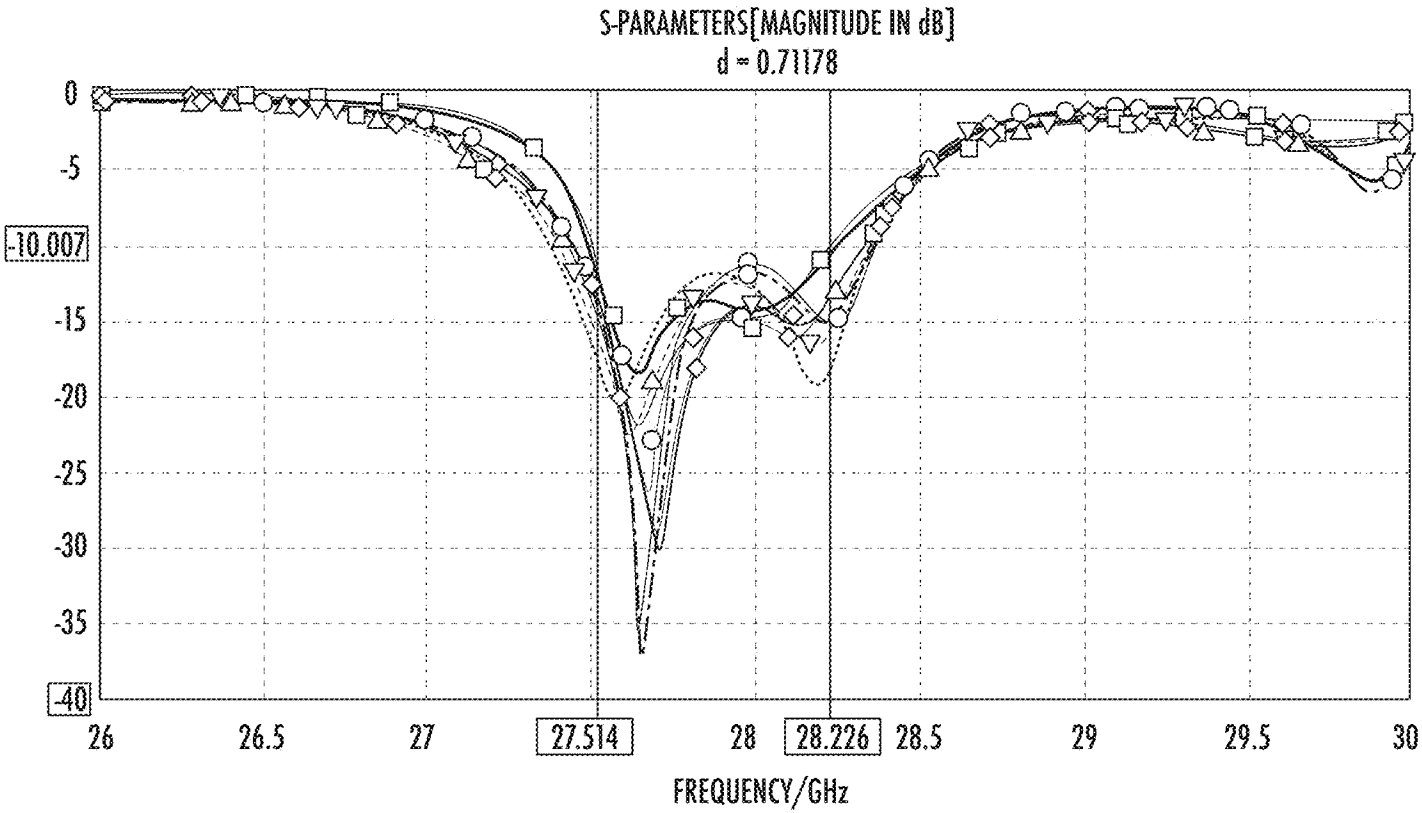
FIG. 3 is a graph illustrating S-parameters of endfire and broadside radiation modes of a configurable phased antenna array according to an embodiment of the presently disclosed subject matter.
Figure 4:
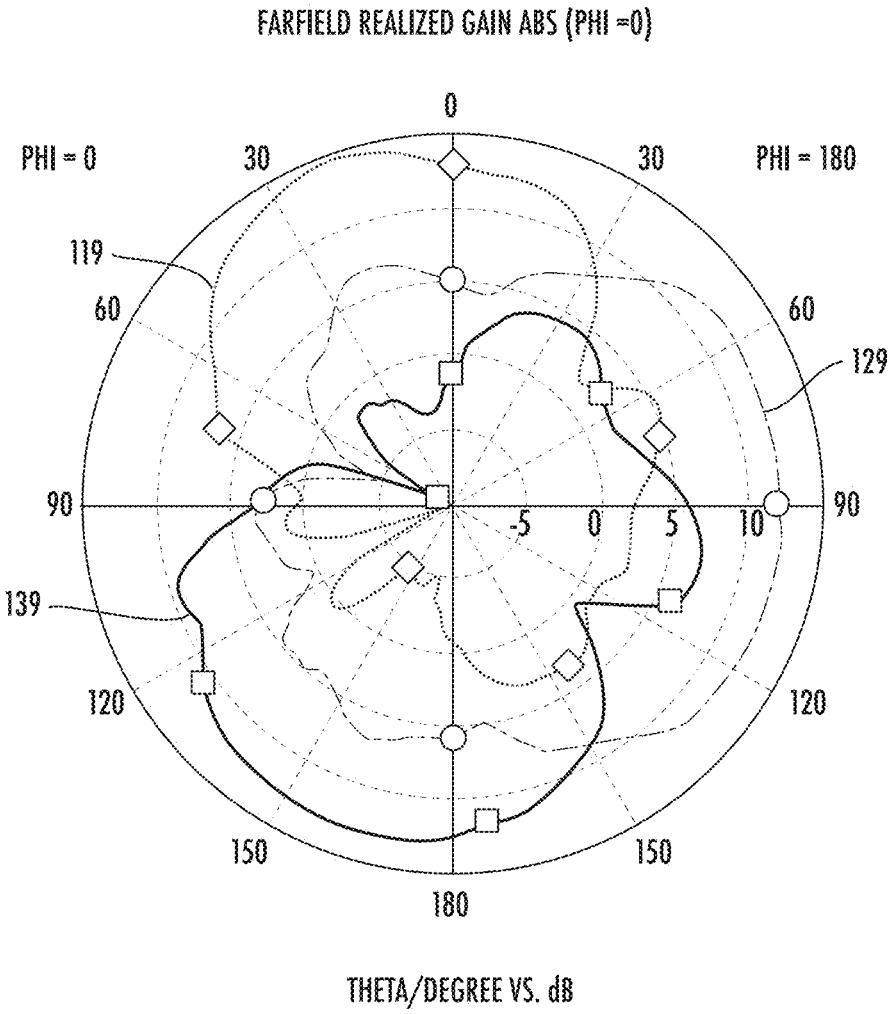
FIG. 4 is a graph illustrating radiation patterns of an endfire mode and two broadside radiation modes of a configurable phased antenna array according to an embodiment of the presently disclosed subject matter.

Referring to FIG. 3, all of the elements are excited separately to illustrate the reflection and coupling for each of the three modes. The overlap −10 dB bandwidth is 719 MHz from 27.5 GHz to 28.2 GHz. FIG. 4 shows the radiation pattern of the three modes in the azimuth plane when all the elements are feeding by the same phase and amplitude. A first radiation pattern 119 represents the device response during a first broadside radiation mode, a second radiation pattern 129 represents the response in an endfire radiation mode, and a third radiation pattern 139 represents the response in a second broadside radiation mode. In this case, the total coverage of 3 dB beamwidth is from 48.2° to 124.2°. The gain is 12.19 dBi for the endfire mode, 14.39 dBi for the "forward" broadside mode and 12.96 dBi for the "backward" broadside mode.

Figure 5A:
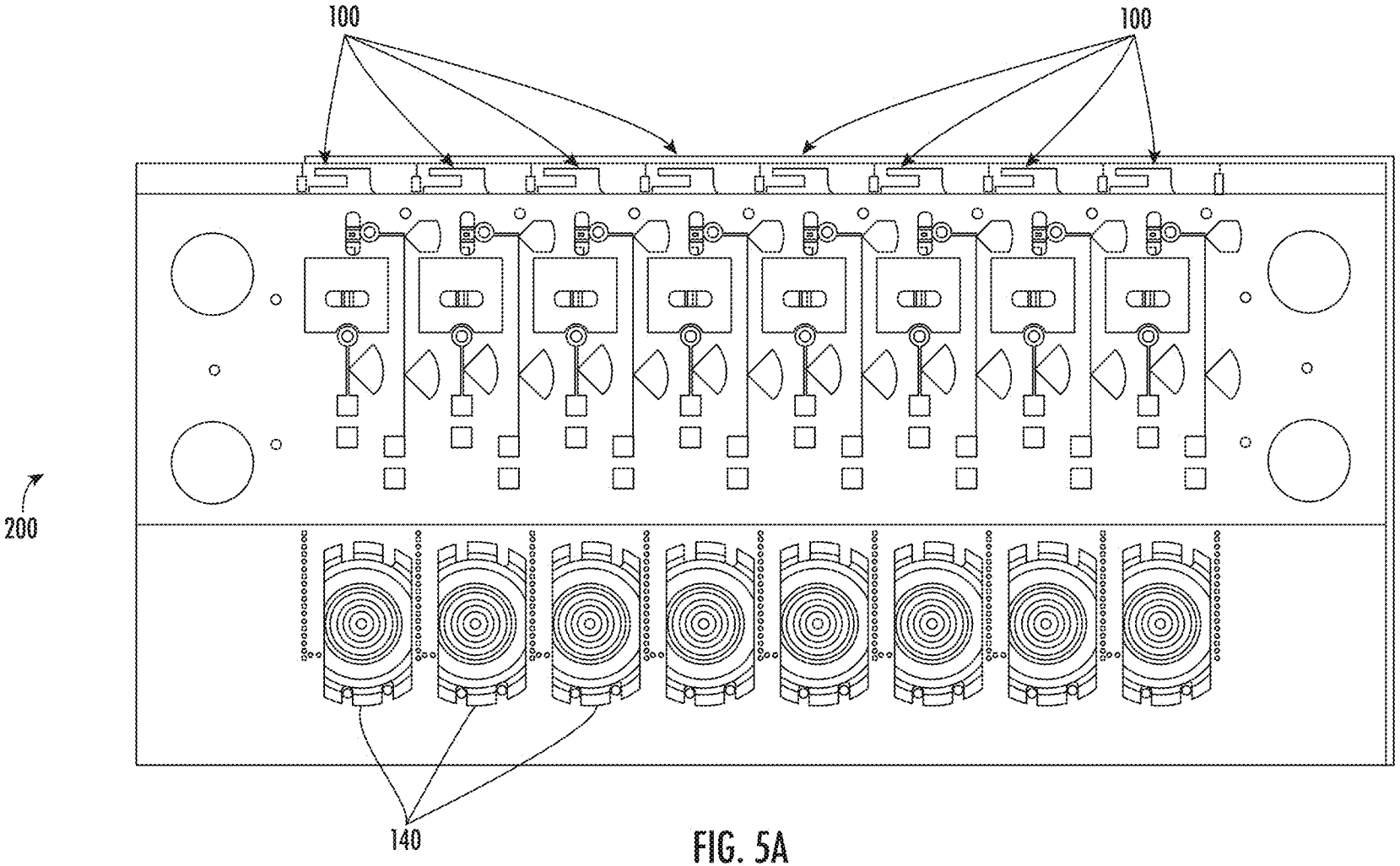
FIGS. 5A and 5B are top and bottom plan views of a configurable phased antenna array according to an embodiment of the presently disclosed subject matter.
Figure 5B:
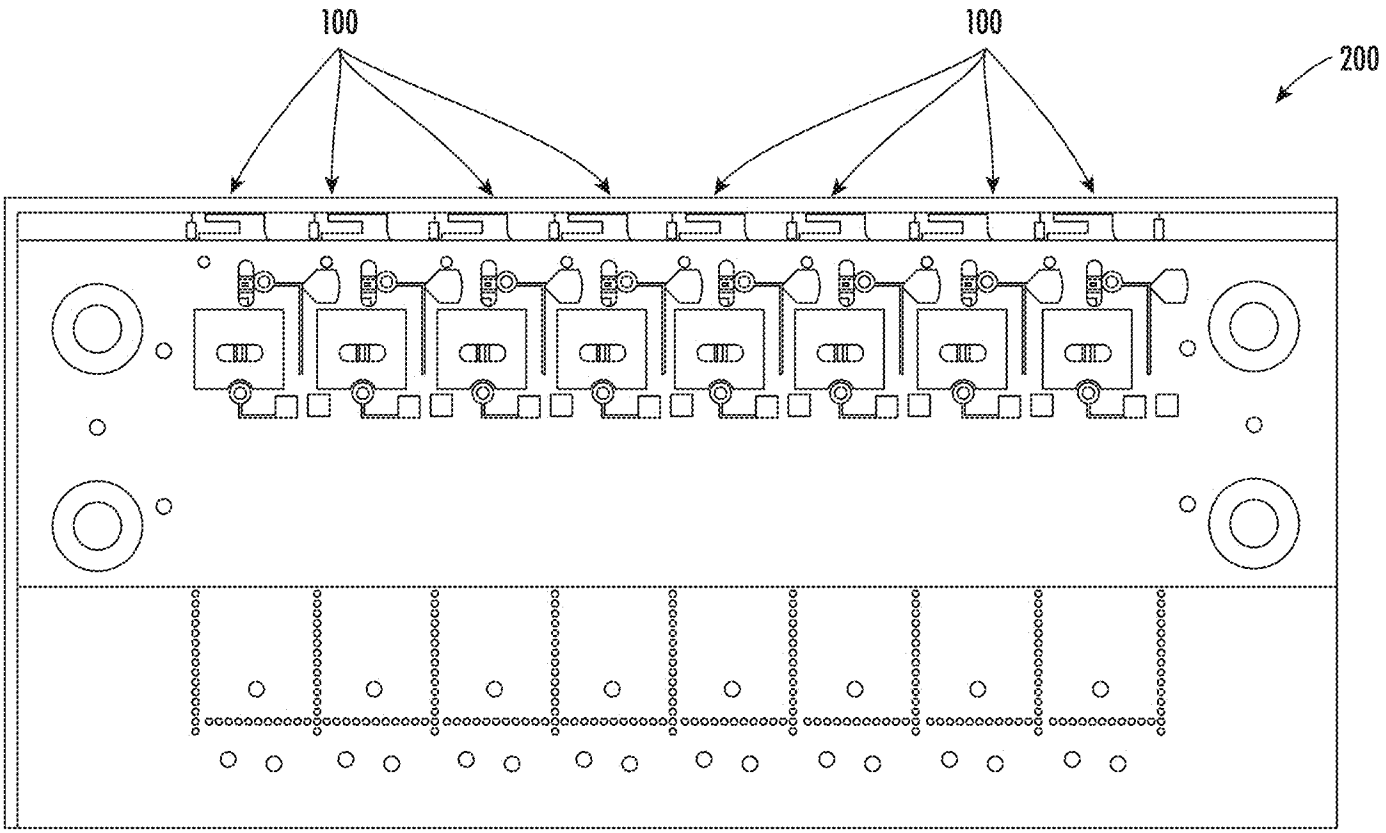

Multiples of antenna assembly 100 can further be combined in a phased array of configurable array elements. As shown in FIGS. 5A and 5B, for example, an antenna array, generally designated 200, includes eight antenna assemblies 100, although those having ordinary skill in the art will recognize that arrays having different numbers of antenna assemblies can also be implemented with correspondingly similar results. Regardless of the number of elements in array 200, the main beam from each antenna assembly 100 can switch in multiple directions by switching among the antenna elements included therein. As discussed above, in some embodiments, each antenna assembly 100 is switchable among one endfire and two broadside directions by controlling the state of first, second, and third switching elements 142*a*, 142*b*, and 142*c* (e.g., PIN diodes) connecting the array elements to a common signal feed (e.g., connected to each device input 140). In some embodiments, individual assemblies or groups of assemblies can be switched independently to connect a selected combination of endfire and broadside elements to the common signal feed. For example, in array 200 having eight elements as illustrated in FIGS. 5A and 5B, first, second, and third switching elements 142*a*, 142*b*, and 142*c* for each antenna assembly 100 can be individually controllable such that some of antenna assemblies 100 are set for endfire operation while others are set for broadside operation. Alternatively, in some embodiments, all assemblies can be switched together to activate all elements in either a "forward" broadside sub-array including one or more of first antenna element 111, a forward endfire sub-array including one or more of second antenna element 121, or a "backward" broadside sub-array including one or more of third antenna element 131. In addition, in some embodiments, the signal beam that is collectively generated by the aggregate combination of beams from each antenna assembly 100 in array 200 can further be steered as a phased array. Combining the two controlling methods, 3D radiation pattern steering is obtained by one linear array with only one RF feeding.

One exemplary configuration of such an array is illustrated in FIGS. 5A and 5B. FIG. 5A is the top view (e.g., associated with the "forward" broadside direction), which shows array 200, including the feeding lines and connectors (e.g., SMA connectors). In the illustrated embodiment, array 200 occupies a space on this side having a total size of approximately 44.35 mm×20 mm. FIG. 5B illustrates a corresponding bottom view (e.g., associated with the "backward" broadside direction), which needs a smaller clearance in this embodiment. In the illustrated embodiment, for example, the total size on this side is approximately 44.35 mm×8.93 mm. For comparison, a thickness of array 200 can be approximately 2.57 mm, thereby providing a representative example of a low-profile form factor that is enabled by the present subject matter that makes array 200 to be readily implemented in handheld mobile devices.

Figure 6:
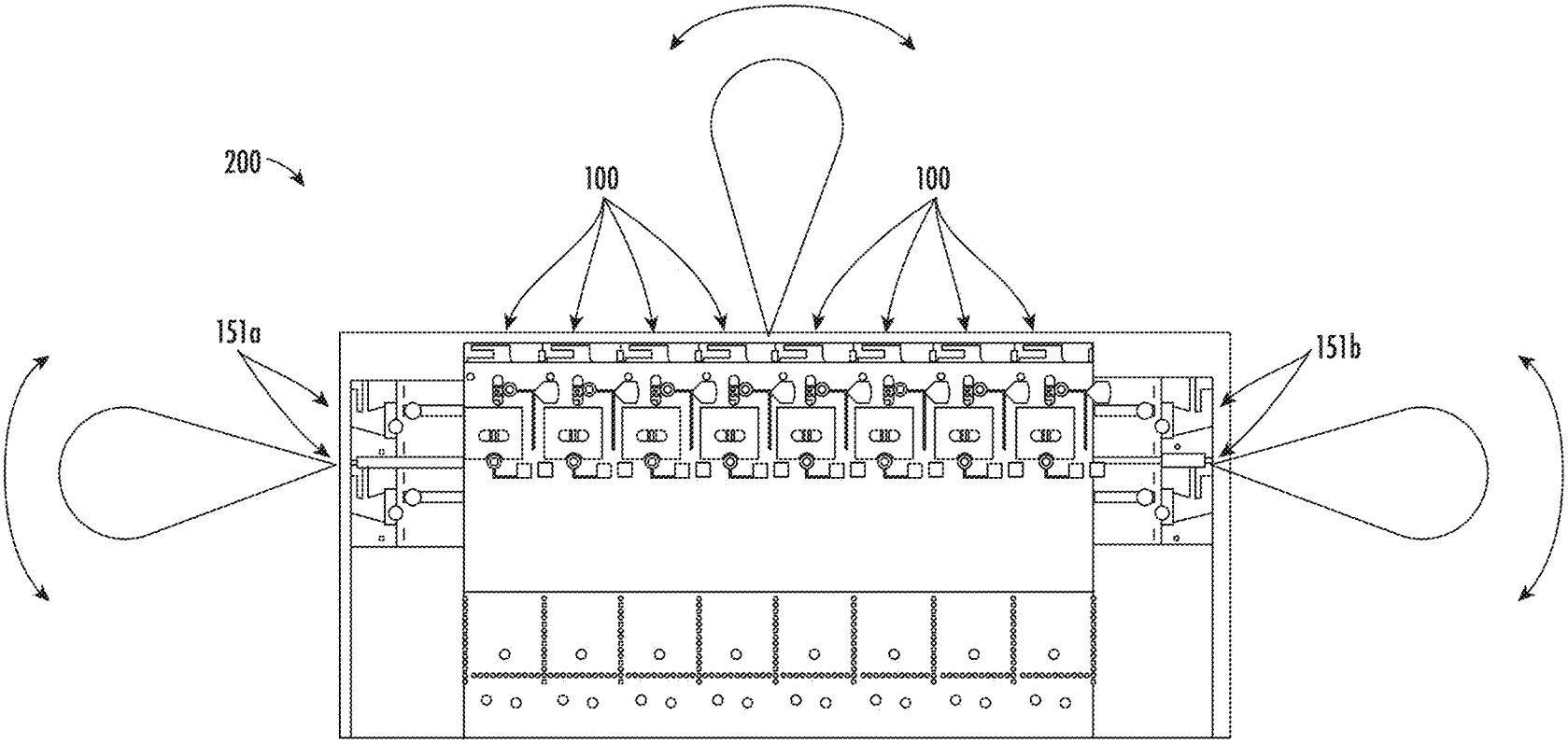
FIG. 6 is a plan view of a configurable phased antenna array according to another embodiment of the presently disclosed subject matter.

In one alternative exemplary configuration, the configurable antenna array 200 can further include one or more additional antenna elements arranged on either or both lateral edges of array 200. In this arrangement, in addition to enabling switching of the main beam among the "forward" broadside sub-array including one or more of first antenna element 111, the forward endfire sub-array including one or more of second antenna element 121, and the "backward" broadside sub-array including one or more of third antenna element 131, the beam can further be configured to be steerable laterally in-plane in either direction with respect to the substantially planar structure of array 200. In the embodiment illustrated in FIG. 6, for example, fourth antenna elements 151*a* are arranged on one side of array 200 and are configured to radiate in a second endfire direction substantially orthogonal to both of the first endfire direction and the first broadside direction, and fifth antenna elements 151*b* are arranged on an opposing side of array 200 and are configured to radiate in a third endfire direction substantially opposite to the second endfire direction. In some other embodiments, different numbers of fourth and/or fifth antenna elements 151*a* or 151*b* can be used. In particular, for example, in some embodiments lateral endfire elements can be provided on only one side of array 200, such as in configurations in which array 200 is positioned about one corner of the device. In any configuration, fourth and/or fifth antenna elements 151*a* or 151*b* can be high-gain endfire antennas that are similar in design to second antenna element 121 discussed above. Alternatively, rather than including only endfire antenna elements in these lateral components, in some embodiments, a complete antenna assembly can be provided in these lateral positions to provide additional elements for use in either broadside sub-array.

Regardless of the particular arrangement, in some embodiments, the additional lateral endfire elements 151 can be switched independently from the second antenna elements 121 of the forward endfire sub-array so that the direction of the beam can be more discretely controlled. Alternatively, in some embodiments, lateral endfire elements 151 can be controlled with the forward endfire sub-array as part of a larger phased sub-array that wraps around the corner of the structure, which broadens the range of angles to which the main beam can sweep.

Figure 7:
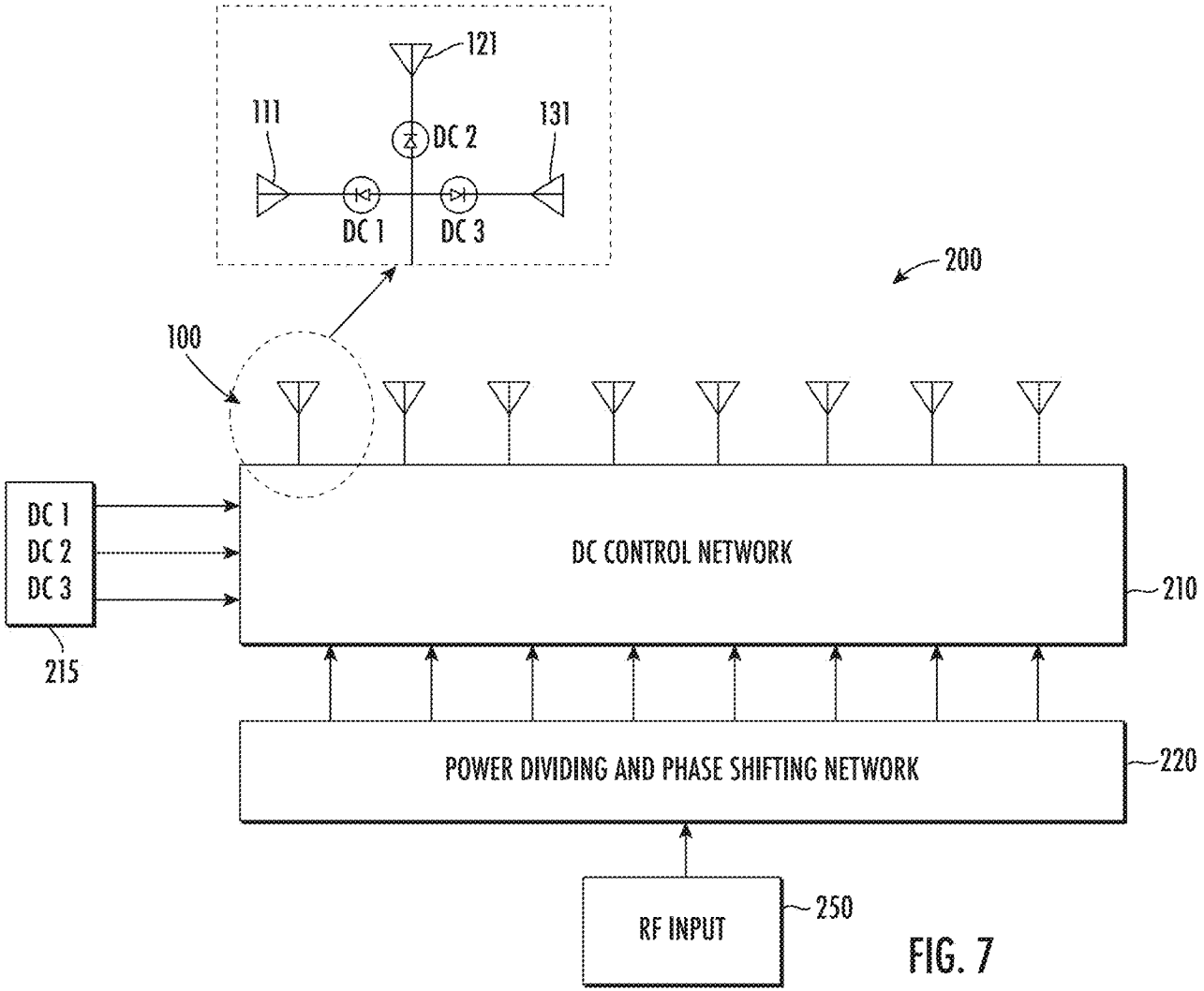
FIG. 7 is an electrical schematic illustrating a control configuration for a configurable phased antenna array according to an embodiment of the presently disclosed subject matter.

Regardless of the particular configuration of antenna elements, antenna array 200 can include one or more control elements that are configured to control the switching among the directional components on each antenna assembly 100. Such a configuration is illustrated in FIG. 7, in which a DC control network 210 is in communication between a common signal feed 250 and each antenna assembly 100 of antenna array 200. Control network 210 can be configured to control the selection of which of the directional elements of each antenna assembly 100 are connected to signal feed 250, for example by controlling the state of the switching elements discussed above. In some embodiments, this control is realized by control network 210 receiving a directional input 215 that identifies the desired subset of antenna elements that are to be activated. As illustrated in FIG. 7, for example, this directional input 215 can provide a set of three differential voltage signals DC 1, DC 2, and DC 3 that are associated with the front broadside array (e.g., first antenna element 111), the forward endfire array (e.g., second antenna element 121), and the rear broadside array (e.g., third antenna element 131), respectively. Based on the pattern of voltage signals received, control network 210 can be configured to communicate with each antenna assembly 100 to select the direction in which energy is transmitted. An example of such a control scheme is provided in Table 2:

TABLE 2

| | "Forward" Broadside | Endfire | "Backward" Broadside |
|---|---|---|---|
| DC 1 | +V | −V | −V |
| DC 2 | −V | +V | −V |
| DC 3 | −V | −V | +V |

Alternatively, in some embodiments, antenna array 200 can include a digital control arrangement to control the switching among the directional components on each antenna assembly 100. Such an arrangement can include a serial or parallel bus in communication with each of first, second, and third switching elements 142*a*, 142*b*, and 142*c* that is configured to provide the selection among the antenna elements on each antenna assembly 100.

In addition, as further illustrated in FIG. 7, the configurable phased antenna array 200 can further include a power-dividing and phase-shifting network 220 that is in communication between control network 210 and signal feed 250. Power-dividing and phase-shifting network 220 can be configured to control the feed to each individual antenna assembly 100, such as by controlling a phase of each signal, to thereby provide constructive/destructive interference to steer an aggregate signal beam in the desired direction. In this arrangement, for a given RF input supplied to antenna array 200 from signal feed 250, the combination of control network 210 and power-dividing and phase-shifting network 220 can control the feed to each antenna assembly 100 so that either or both of the broad directional radiation mode and/or the relative phase among active elements is selectable to achieve 3D radiation pattern sweeping.

Figure 8A:
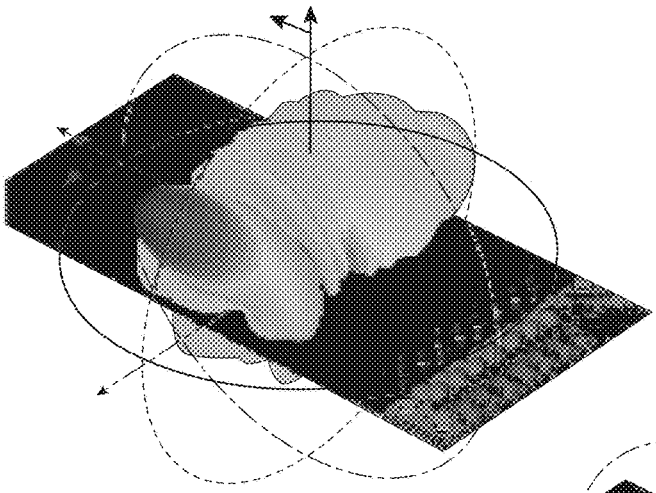
FIGS. 8A through 8O are perspective views of radiation patterns at various beam sweep positions of a configurable phased antenna array according to an embodiment of the presently disclosed subject matter.
Figure 8B:
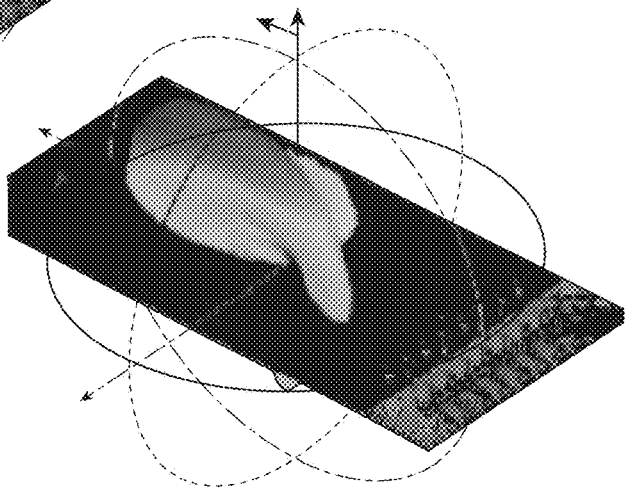
Figure 8C:
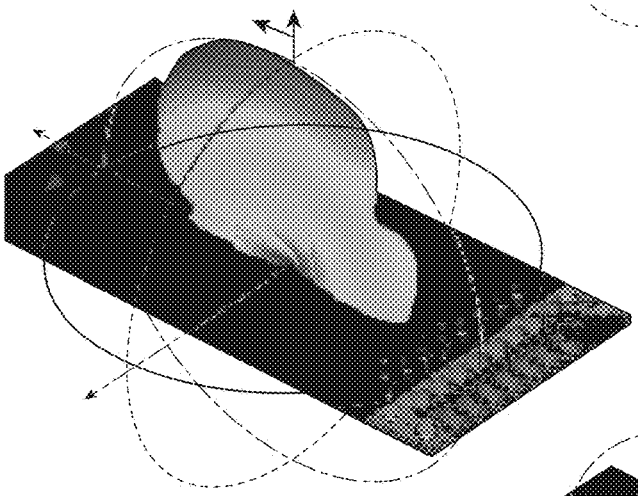
Figure 8D:
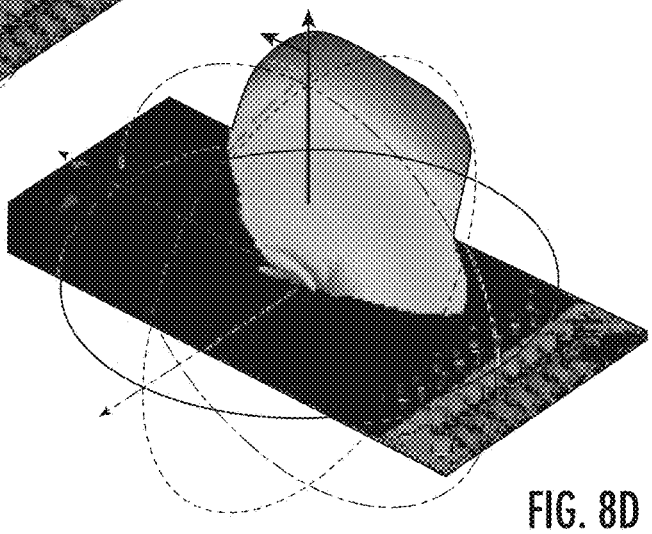
Figure 8E:
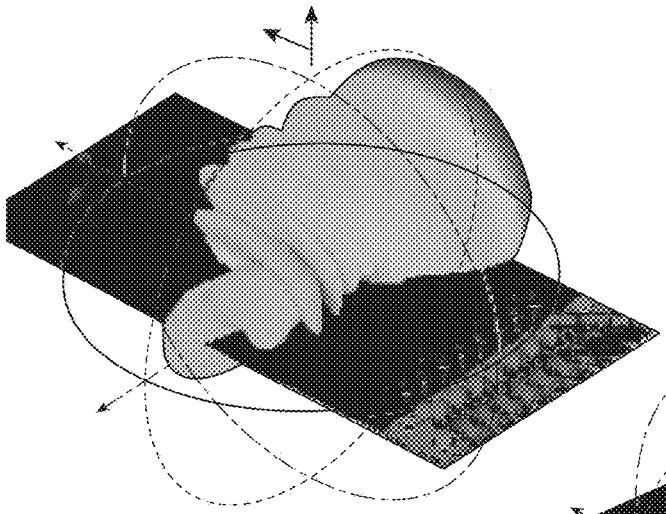
Figure 8F:
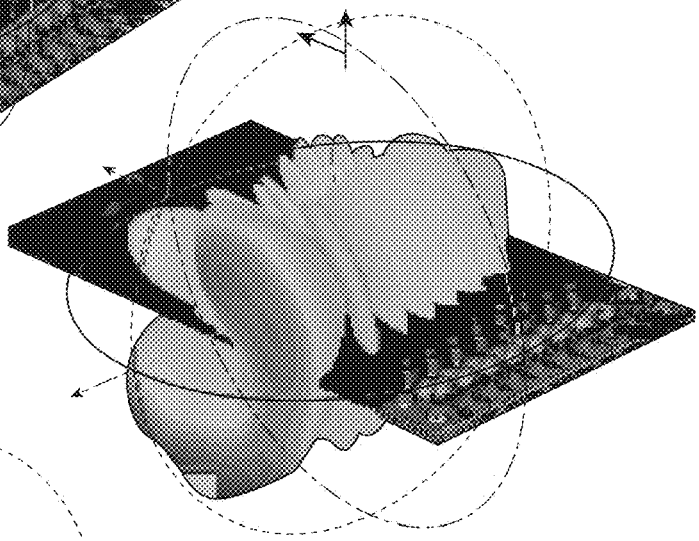
Figure 8G:
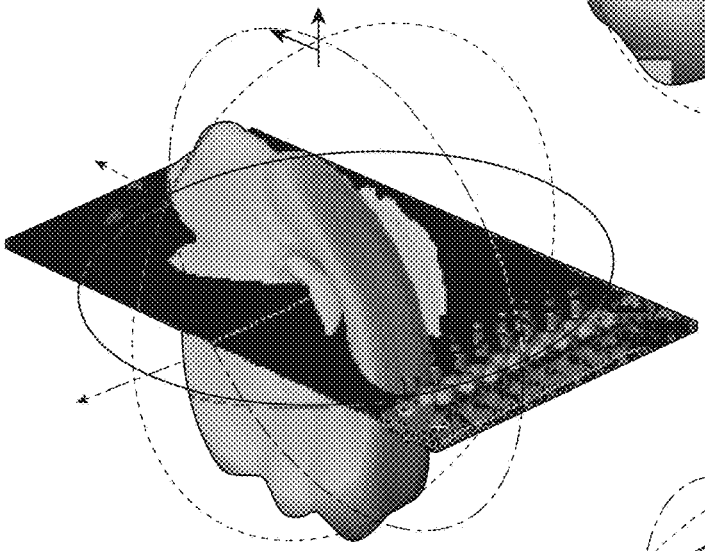
Figure 8H:
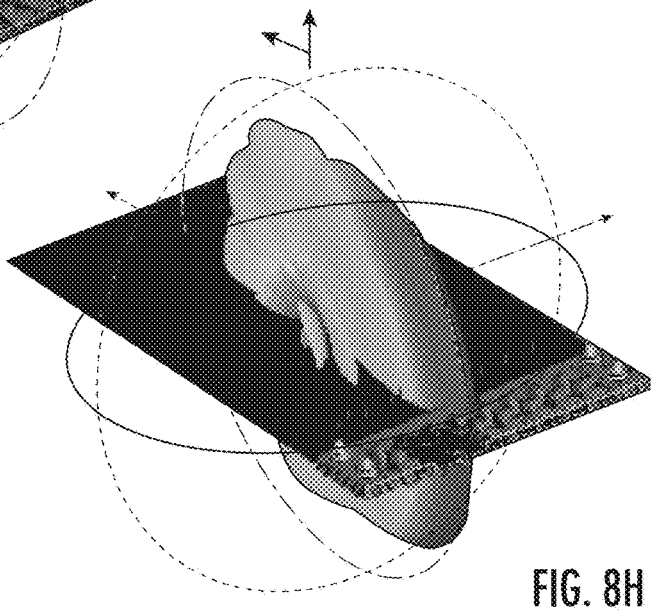
Figure 8I:
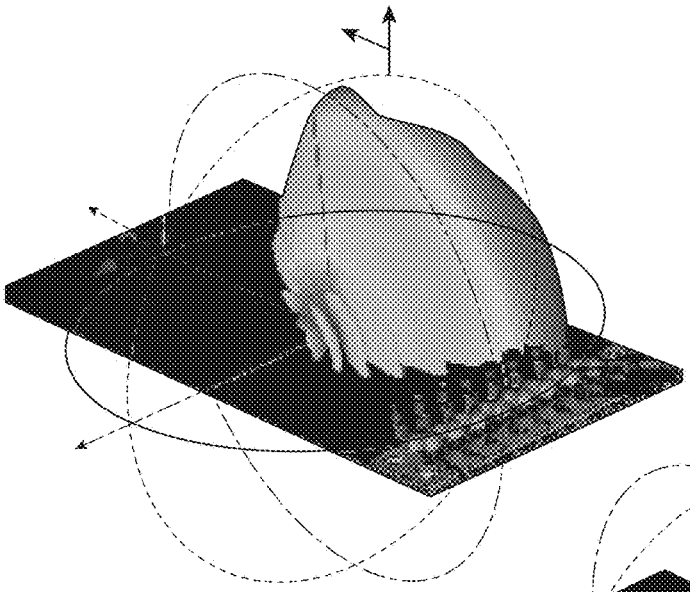
Figure 8J:
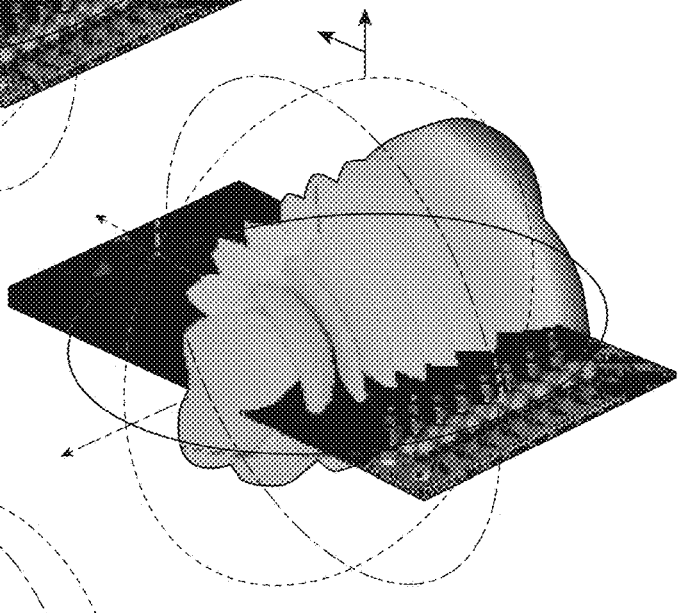
Figure 8K:
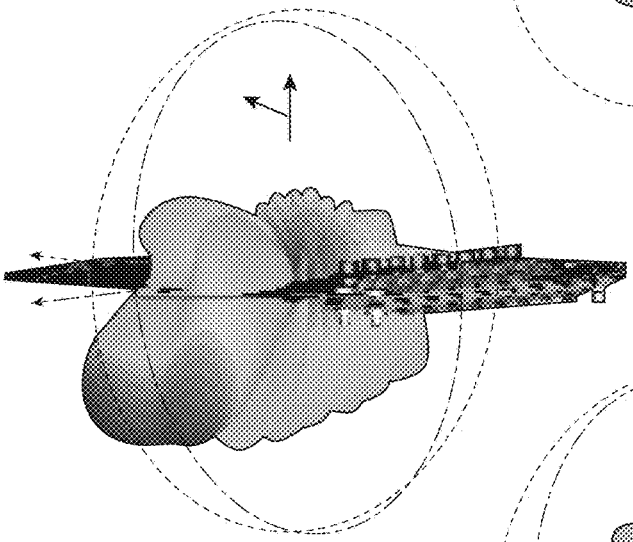
Figure 8L:
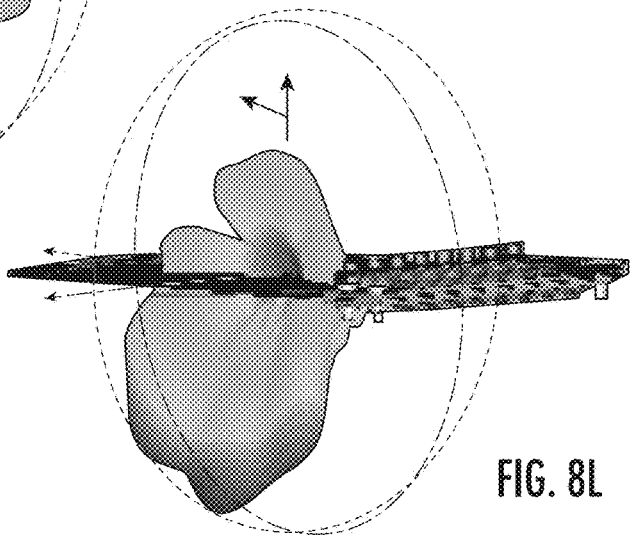
Figure 8M:
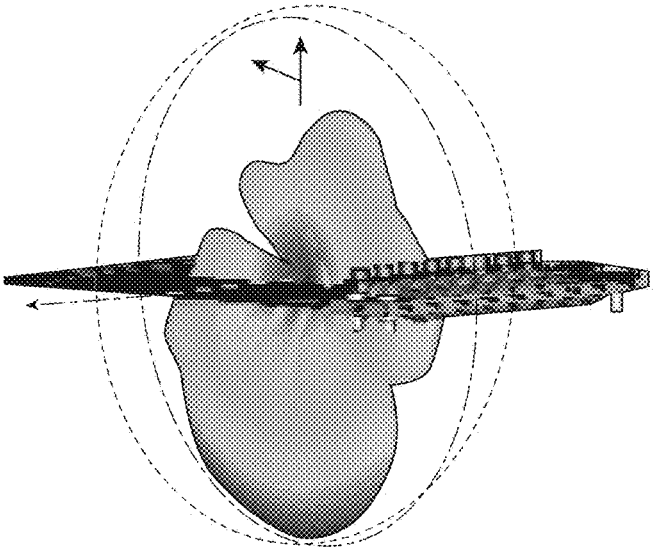
Figure 8N:
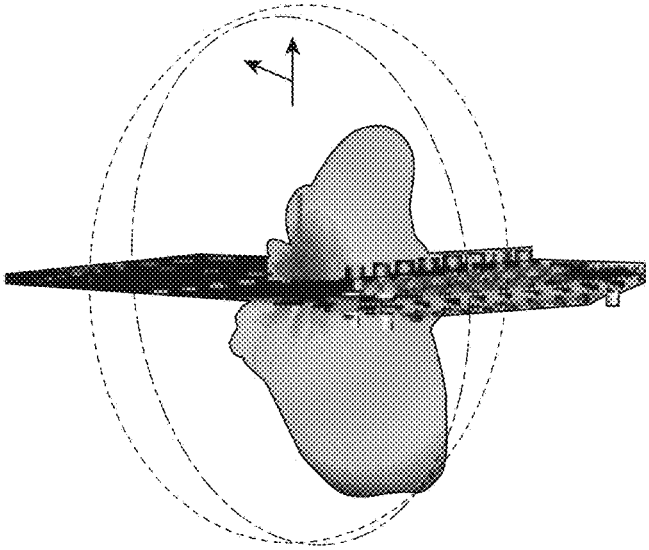
Figure 80:
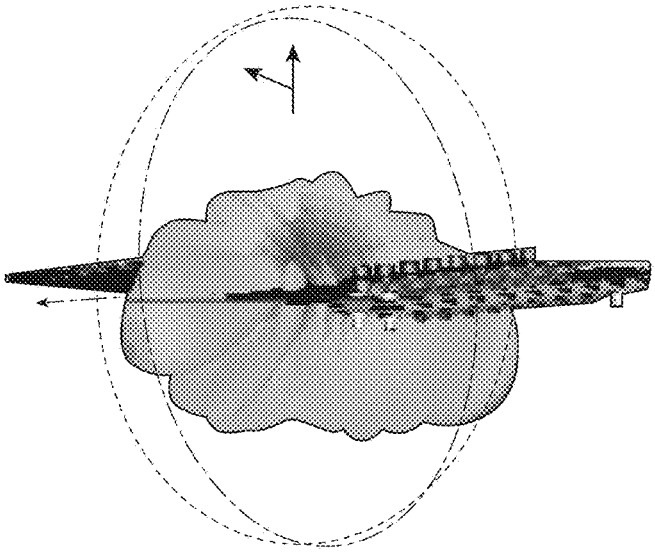

FIGS. 8A-8O show the steering of the aggregate signal beam in each of the three modes: FIGS. 8A-8E illustrate a sweep by a sub-array of forward-facing broadside elements (e.g., first antenna elements 111), FIGS. 8F-8J illustrate a sweep by a sub-array of endfire elements (e.g., second antenna elements 121), and FIGS. 8K-8O illustrate a sweep by a sub-array of rear-facing broadside elements (e.g., third antenna elements 131). The sweeping angle covers from −54° to +54° in the horizontal plane with the realized gain ranging from 8.8 dBi to 14.4 dBi.

Accordingly, the present subject matter can provide improved coverage in space by implementing a phased array using configurable antenna assemblies. In this way, 3D radiation pattern sweeping is achieved using one linear array with only one RF feeding. In addition, the present subject matter provides a planar structure which can easily integrated with other parts in mobile terminals. This implementation of 3D radiation pattern steering with only one feed can further decrease the complexity of feeding networks.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A configurable antenna assembly comprising:

at least two antenna elements comprising:

a first antenna element; and a second antenna element;

a substrate integrated waveguide in communication with a common device input; and a plurality of switching elements configured to selectively connect one of the at least two antenna elements to the substrate integrated waveguide and the common device input;

wherein the configurable antenna assembly is configured to radiate in a first broadside direction when the plurality of switching elements connect the first antenna element to the common device input; and wherein the configurable antenna assembly is configured to radiate in a first endfire direction when the plurality of switching elements connect the second antenna element to the common device input.

2. The configurable antenna assembly of claim 1, wherein the second antenna element comprises a monopole element.

3. The configurable antenna assembly of claim 1, wherein the second antenna element comprises two arms that are separated by a slot, wherein dimensions of the two arms and the slot are selected to achieve a desired bandwidth for signals in the endfire direction.

4. The configurable antenna assembly of claim 1, wherein the first antenna element comprises a first patch antenna.

5. The configurable antenna assembly of claim 1, wherein the plurality of switching elements comprises:

a first switching element configured to selectively connect the first antenna connected to the common device input; and a second switching element configured to selectively connect the second antenna element to the common device input;

wherein a controller in communication with the plurality of switching elements is configured to select which one of the plurality of switching elements is configured to allow communication with the common device input.

6. The configurable antenna assembly of claim 1, wherein the plurality of switching elements comprises a plurality of PIN diodes.

7. The configurable antenna assembly of claim 1, wherein the plurality of switching elements are selected from the group consisting of field-effect transistor (FET) switches, bipolar junction transistor (BJT) switches, semiconductor transistor switches, and micro-electro-mechanical systems (MEMS) switches.

8. The configurable antenna assembly of claim 1, comprising a multi-layer structure including:

a first material layer comprising the first antenna element; and a second material layer comprising the second antenna element, the substrate integrated waveguide in communication with the common device input, and the plurality of switching elements.

9. The configurable antenna assembly of claim 8, wherein the first material layer further comprises feed lines for the first antenna element and the second antenna element.

10. The configurable antenna assembly of claim 1, wherein the at least two antenna elements comprises a third antenna element;

wherein the configurable antenna assembly is configured to radiate in a second broadside direction substantially opposite to the first broadside direction when the plurality of switching elements connect the third antenna element to the common device input.

11. The configurable antenna assembly of claim 10, wherein the third antenna element comprises a second patch antenna.

12. The configurable antenna assembly of claim 10, wherein the plurality of switching elements comprises a third switching element configured to selectively connect the third antenna element to the common device input.

13. A configurable phased antenna array comprising:

a plurality of configurable antenna assemblies in communication with a common signal feed, each antenna assembly comprising:

at least two antenna elements comprising:

a first antenna element; and a second antenna element; and a plurality of switching elements configured to selectively connect one of the at least two antenna elements to a common device input in communication with the common signal feed;

wherein each of the plurality of configurable antenna assemblies is configured to radiate in a first broadside direction when the plurality of switching elements connect the first antenna element to the common device input; and wherein each of the plurality of configurable antenna assemblies is configured to radiate in a first endfire direction when the plurality of switching elements connect the second antenna element to the common device input; and wherein the plurality of configurable antenna assemblies are operable as a phased array to steer an aggregate signal beam in a desired direction based on which one of the at least two antenna elements of each of the plurality of configurable antenna assemblies are connected to the common signal feed.

14. The configurable phased antenna array of claim 13, wherein the at least two antenna elements comprises a third antenna element;

wherein each of the plurality of configurable antenna assemblies is configured to radiate in a second broadside direction substantially opposite to the first broadside direction when the plurality of switching elements connect the third antenna element to the common device input.

15. The configurable phased antenna array of claim 13, comprising at least one fourth antenna element;

wherein each of the plurality of configurable antenna assemblies is configured to radiate in a second endfire direction substantially orthogonal to both of the first endfire direction and the first broadside direction when the plurality of switching elements connect the fourth antenna element to the common device input.

16. The configurable phased antenna array of claim 15, comprising at least one fifth antenna element;

wherein each of the plurality of configurable antenna assemblies is configured to radiate in a third endfire direction substantially opposite to the second endfire direction when the plurality of switching elements connect the fifth antenna element to the common device input.

17. The configurable phased antenna array of claim 13, comprising a control network in communication with each of the plurality of configurable antenna assemblies and configured to select which of the plurality of switching elements associated with each of the plurality of configurable antenna assemblies are configured to allow communication with the common signal feed.

18. The configurable phased antenna array of claim 17, wherein the control network comprises a DC control network configured to provide differential voltage signals to the plurality of switching elements.

19. The configurable phased antenna array of claim 17, wherein the control network comprises a digital control network comprising a serial or parallel bus in communication with each of the plurality of switching elements.

20. The configurable phased antenna array of claim 13, comprising a power-dividing and phase-shifting network that is configured to control a phase of a signal between the common signal feed and each of the plurality of configurable antenna assemblies to steer the aggregate signal beam in the desired direction.

21. A method for operating an antenna assembly, the method comprising:

supplying an RF input from a common signal feed to one or more configurable antenna assemblies, each of the one or more configurable antenna assemblies comprising:

a substrate integrated waveguide connected to a common device input in communication with the common signal feed; and at least two antenna elements comprising:

a first antenna element; and a second antenna element; and selectively connecting one of the at least two antenna elements of each of the one or more configurable antenna assemblies to the substrate integrated waveguide and the common device input to change a direction of a beam produced by the assembly;

wherein the configurable antenna assembly radiates in a first broadside direction when the first antenna element is connected to the common device input; and wherein the configurable antenna assembly radiates in a first endfire direction when the second antenna element is connected to the common device input.

22. The method of claim 21, wherein the at least two antenna elements comprises a third antenna element;

wherein the configurable antenna assembly radiates in a second broadside direction substantially opposite to the first broadside direction when the third antenna element is connected to the common device input.

23. The method of claim 21, wherein supplying an RF input comprises controlling a phase of a signal between each of the one or more configurable antenna assemblies and the common signal feed to steer an aggregate signal beam in a desired direction.

* * * * *